US006139208A

United States Patent [19]

Monin-Bareil

[11] Patent Number: 6,139,208

[45] Date of Patent: Oct. 31, 2000

[54] LIPSTICK TUBE

[75] Inventor: Richard Monin-Bareil, Barcelona, Spain

[73] Assignee: Techpack Espana, S.L., Barcelona, Spain

[21] Appl. No.: 09/270,523

[22] Filed: Mar. 17, 1999

[30] Foreign Application Priority Data

Mar. 20, 1998 [ES] Spain ..... 9800757

[51] Int. Cl.[7] ..... B43K 21/08

[52] U.S. Cl. ..... 401/78; 401/55

[58] Field of Search ..... 401/78, 55, 58, 401/65, 68, 70, 71, 75, 77, DIG. 1

[56] References Cited

U.S. PATENT DOCUMENTS

| | | | |
|---|---|---|---|
| 5,234,275 | 8/1993 | Gueret | 401/78 |
| 5,749,664 | 5/1998 | Inoue et al. | 401/78 |
| 5,888,003 | 3/1999 | Pierpont | 401/78 |

FOREIGN PATENT DOCUMENTS 2639260 11/1988 France .

*Primary Examiner*—Henry J. Recla
*Assistant Examiner*—Huyen Le
*Attorney, Agent, or Firm*—Dennison, Scheiner, Schultz & Wakeman

[57] ABSTRACT

A lipstick tube is disclosed that includes a cylindrical tube body (3) provided with a wall with vertical grooves (2), inside which a bottom part (9) moves and supports a lipstick and is equipped with two pins which pass through the grooves in the tube body and move along the helical grooves (40) formed on the inside an external spiral (4) coaxially surrounding the tube body (3), such that relative movement of rotation between the tube body (3) and the spiral (4) causes axial displacement of the bottom part (9). The tube body (3) and the spiral (4) include click-fit means in the axial direction that work together to permanently assemble the tube body (3). The spiral (4) and the tube body (3) have at least one radial spacer (7,70,8,80) of thickness E which forms a circumferential linear contact (71,81), such that, after click-fitting, a predetermined permanent mutual pressure is exerted between the tube body (3) and the spiral (4) along the contact (71,81), so as to give a minimum contact surface area between the spiral (4) and the tube body (3) and obtain a uniform torque of predetermined level in the relative rotation movement between the two elements (3) and (4), without the use of any lubricant.

11 Claims, 6 Drawing Sheets

LIPSTICK TUBE

FIELD OF THE INVENTION

This invention relates to lipstick tubes.

STATE OF THE ART

Lipstick tubes are normally structured based on a grooved and fixed tube body equipped with a pair of grooves facing diametrically opposite generating lines, and pins forming part of a support or bottom part usually associated with the lipstick which act in cooperation with each of these grooves, the free end of the said pins fitting into a surrounding cylinder, commonly called a spiral since there are one or two helical grooves on the inside of the said cylinder wall, with which the said pins on the bottom part interact, such that the rotational movement of the spiral with respect to the grooved tube body causes upwards or downwards axial displacement of the bottom part with the lipstick concerned.

The grooved tube body and the spiral come into contact through a large cylindrical area, and this is why there is a tendency for sticking to occur during the rotational movement, which in practice is avoided by application of a coat of an appropriate lubricant between surfaces in contact.

PROBLEM TO SOLVE

Apart from the extra cost necessary to supply and apply the said lubricant, this solution introduces a problem related to the possibility that leaks of the said lubricant could be annoying to the tube purchaser or user, particularly when the packaging has been stored for a long time and there is a risk that these substances could become rancid.

AIM OF THE INVENTION

The aim of the invention is a lipstick tube, in which the structural characteristics have been designed so that a uniform torque is obtained during relative movement between the tube body and the spiral, without any conventional lubricant being applied to the surfaces in contact with these elements.

DESCRIPTION OF THE INVENTION

The lipstick tube (1) of the invention comprises a cylindrical tube body (3), provided with a wall with typically vertical grooves (2), inside which a bottom part (9) moves supporting a lipstick and equipped with two pins which pass through the grooves in the tube body, and move along the helical grooves (40) formed on the inside an external spiral (4) coaxially surrounding the said tube body (3), such that relative movement of rotation between the tube body (3) and the spiral (4) causes axial displacement of the bottom part (9) and consequently the lipstick attached to it, and is characterized in that:

a) the said tube body (3) and the said spiral (4) comprise click-fit means in the axial direction that work together to permanently assemble the said tube body (3) and the said spiral (4), b) the said tube body (3) and/or the said spiral (4) comprise at least one means of radial spacing or radial spacer (7,70,8,80) of thickness E which forms a circumferential linear contact (71,81), typically at one of their common ends, and the radial dimensions of the said tube body (3) and the said spiral (4), and particularly the thickness E and the difference $R_4-R_3$ between the inside radius $R_4$ of the said spiral (4) and the outside radius $R_3$ of the said tube body (3), being chosen such that, after click-fitting, a predetermined permanent mutual pressure is exerted between the said tube body (3) and the spiral (4) along said contact (71, 81), so as to give a minimum contact surface area between the spiral (4) and the tube body (3) and to obtain a uniform torque of predetermined level in the relative rotation movement between the two elements (3) and (4), without the use of any lubricant.

The combination of means under a) and b) solves the set problem since it enables perfect relative sliding between the spiral and the tube body without the use of any lubricants and with a perfectly uniform torque. In the tubes of the present invention, the contact between the tube body and the spiral is a narrow line of circumferential contact rather than a large surface areas of contact between these parts, thus minimizing friction between the parts and making the use of lubricants unnecessary as mentioned above.

DESCRIPTION OF THE DRAWINGS

All the figures are tubes or parts of tubes according to the invention.

DETAILED DESCRIPTION OF THE INVENTION

The present invention is a combination of two means, under a) and b) as seen before, each having its own function. These functions have to be maintained separated: in the case in which part of the axial click-fit means could also act as a radial spacer and possibly make an adjacent radial spacer inoperative, the thickness $E_{7,8,70,80}$ of the said adjacent radial spacer is chosen to be greater than the thickness $E'_{30}$ of the said part of the said click-fit means, the difference in thickness E−E' being equal to at least 0.025 mm.

Figures 3, 3A:
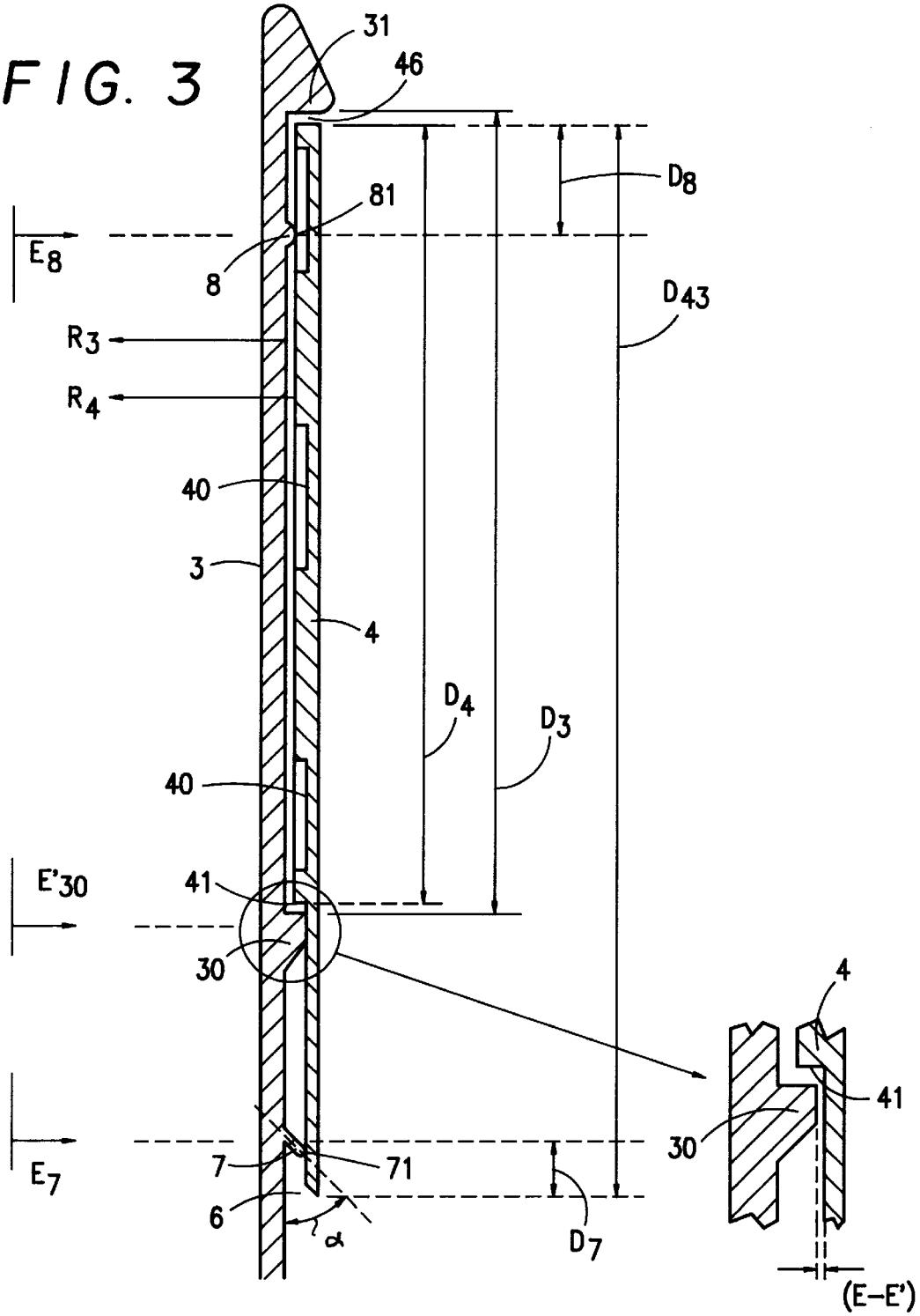
FIG. 3 corresponds to the right part of FIG. 1, specifically dealing with the tube body (3) and the spiral (4).
FIG. 3*a* is an enlarged view of FIG. 3.

FIG. 3*a* shows an example of thickness E−E'>0.

Click-fit means may have a lot of embodiments. According to a first embodiment, the said tube body (3) comprises top (31) and bottom (30) stops that axially block the said spiral (4) by cooperation either with at least one end (46) of the said spiral, or with at least one shoulder (41) so as to form the said click-fit means.

Figure 4A:
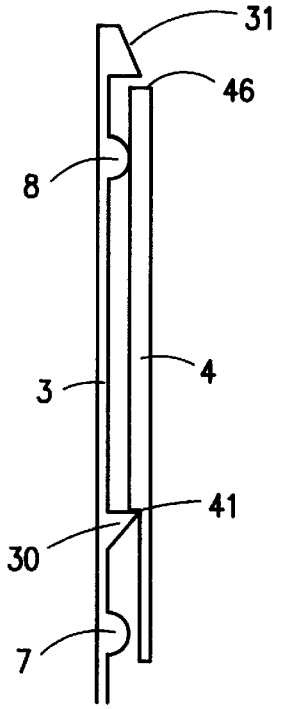
FIGS. 4*a* to 6*d* are similar to FIG. 3, and are embodiments of tubes differing by the way the tube body (3) and the spiral (4) cooperate.
Figure 4B:
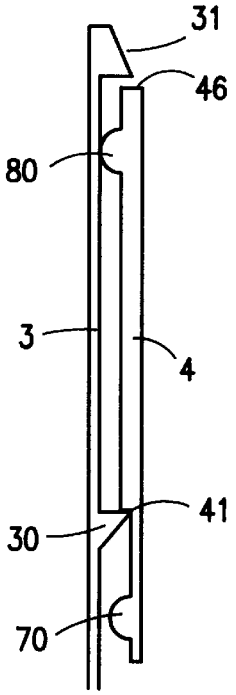
Figure 4C:
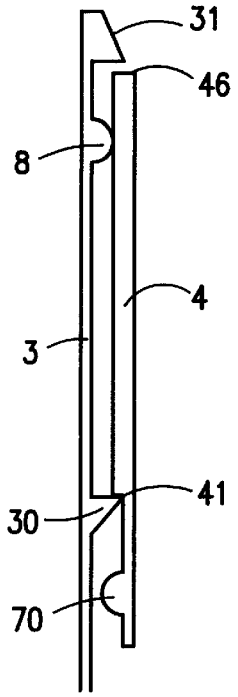
Figure 4D:
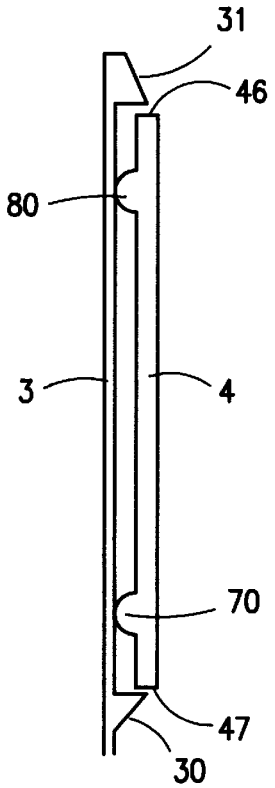
Figure 4E:
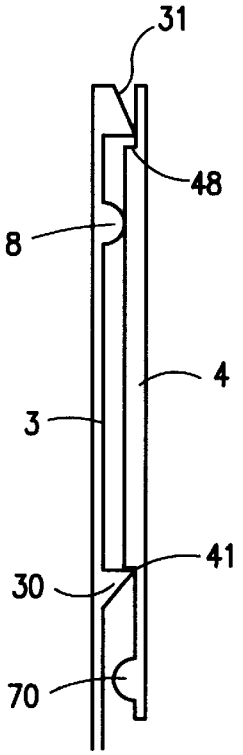
Figure 5A:
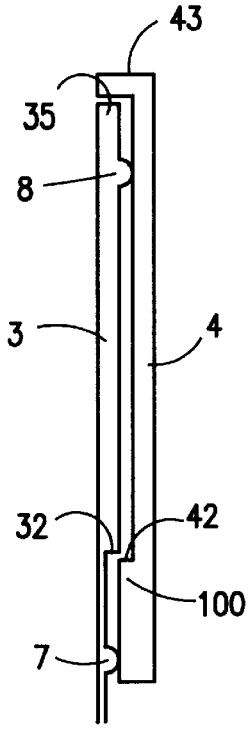
Figure 5B:
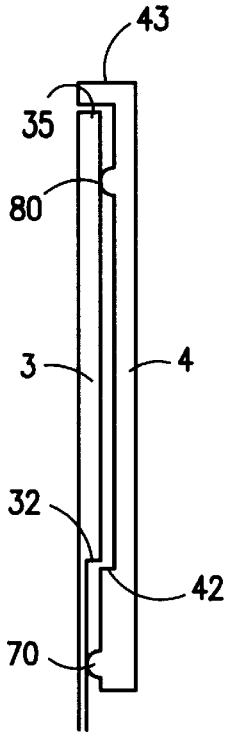
Figure 5C:
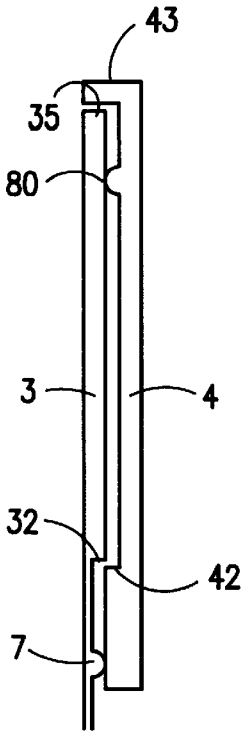
Figure 5D:
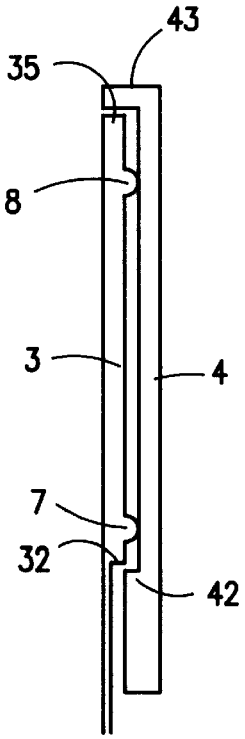
Figure 5E:
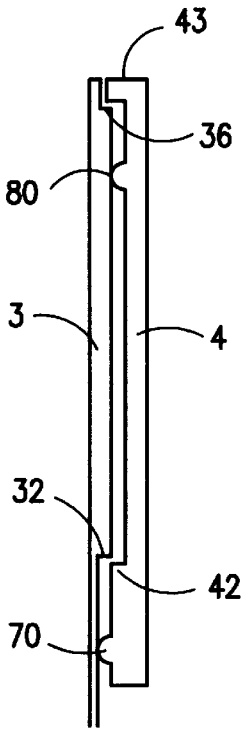
Figure 6A:
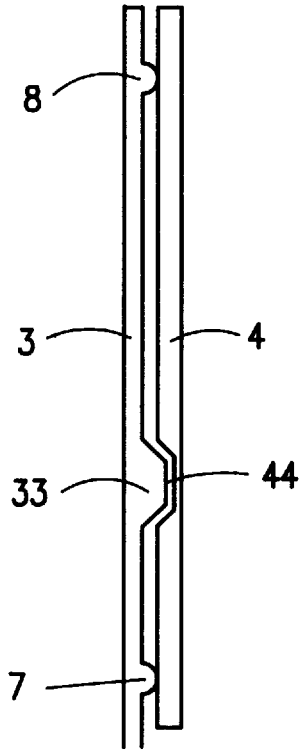
Figure 6B:
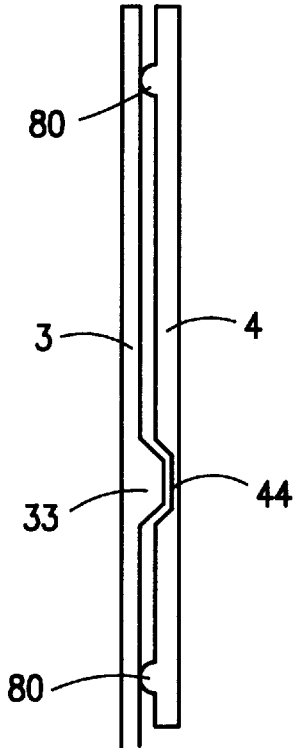
Figure 6C:
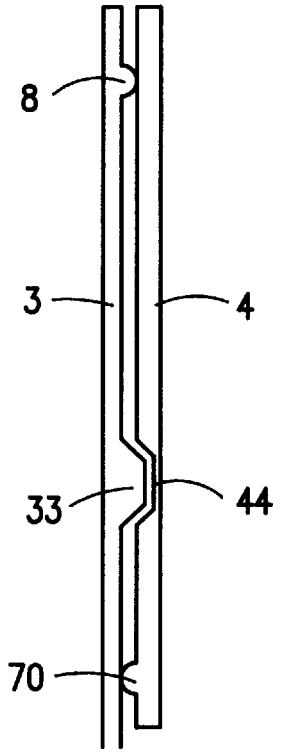
Figure 6D:
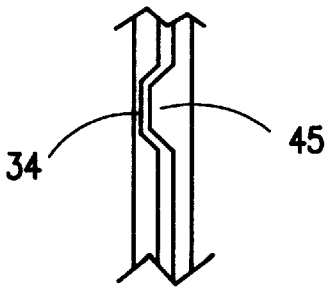

In this case, the said spiral click-fits with the said tube body, either by one end (46) and a shoulder (41) (see FIGS. 4*a* to 4*c*), or by both ends (46) and (47) (see FIG. 4*d*), or by two shoulders (41) and (48) (see FIG. 4*e*).

According to a second embodiment, the said spiral (4) comprises top (43) and bottom (42) stops that axially block the said tube body (3) by cooperation either with at least one end (35) of the said tube body, or with at least one shoulder (32) in order to form the said click-fit means.

In this case, the said tube body click-fits with the said spiral either through one end (35) and one shoulder (32) (see FIGS. 5*a* to 5*d*), or by two shoulders (32) and (36) (see figure Se). According to a third embodiment, the said click-fit means involves cooperation between a rib (33, 45)

and an axial blocking groove (44, 34), the said tube body supporting the said rib (33) or the said groove (34) and the said spiral supporting the said groove (44) or the said rib (45) respectively. See FIGS. 6*a* to 6*d*.

Technical considerations, for instance the easiness to mold a piece, or esthetical consideration can influence the choice of a specific embodiment.

As far as the means of radial spacing or radial spacers are concerned, the tube of the invention may comprise only one spacer, but preferably comprises two radial spacers (7 or 70) and (8 or 80), one being located in the first third of the common height $D_{43}$, the other being located in the third third of this common height, as shown at FIG. 3.

FIG. 3 shows that:

spacer (8) is at a distance $D_8$ from the common top end of both parts (3) and (4), spacer (7) is at a distance $D_7$ from the common bottom end of both parts (3) and (4), the common height of parts (3) and (4) is $D_{43}$, and $D_7$ as well as $D_8$ are smaller than $D_{43}/3$.

With two spacers, the tube body and the spiral are automatically centered without any interference or friction.

Figure 1:
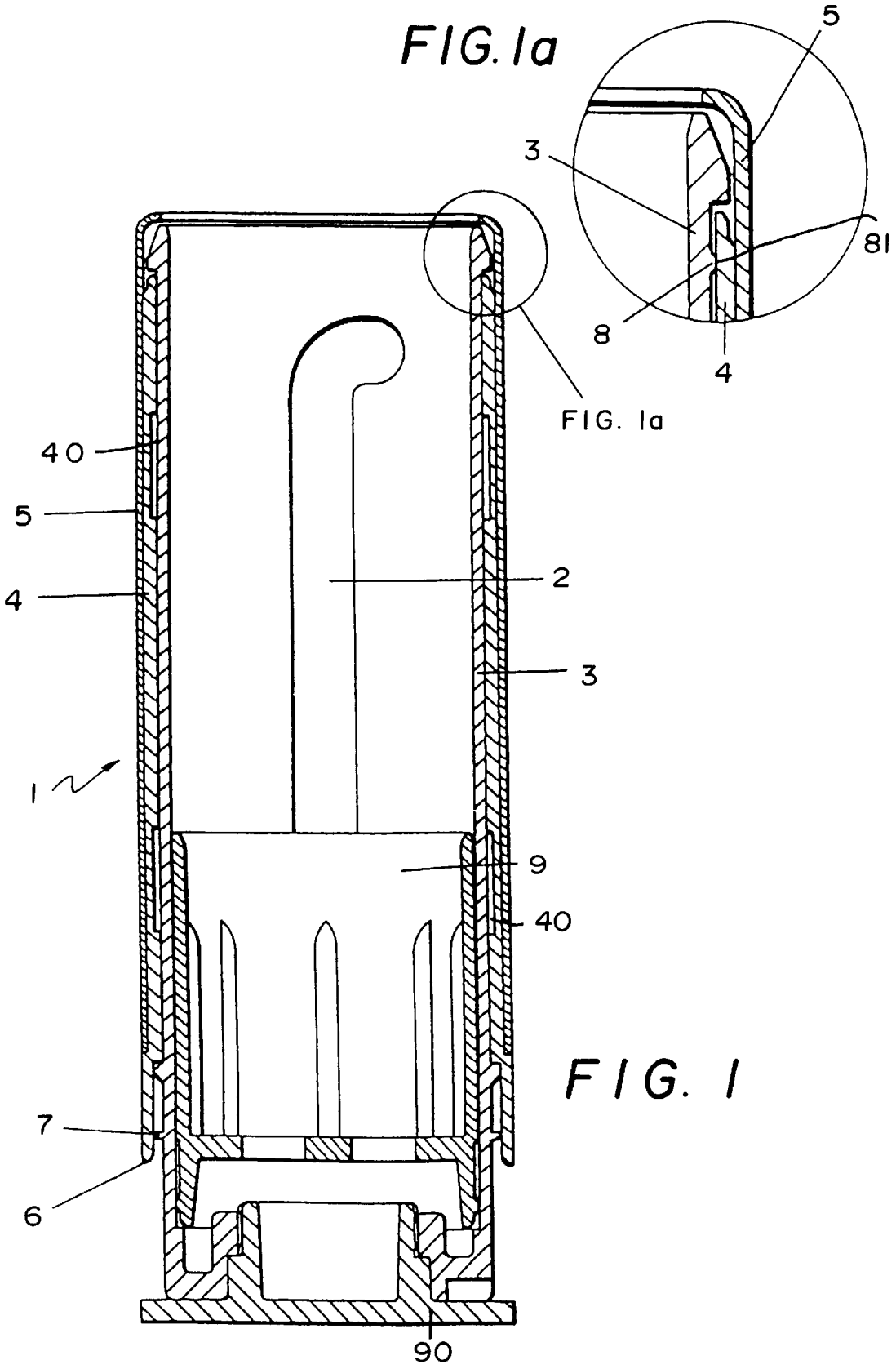
FIG. 1 represents a projected side view and a cross section through the diameter of a lipstick tube (1), with an enlarged detail at the upper end of the tube body (FIG. 1*a*).

Preferably, the said radial spacers between the said tube body (3) and the said spiral (4) consist of an upper circular contact rib (8, 80) and a lower contact rib (7,70) that form a "circular ring/cylinder" type tangential contact with two lines of contact (71,81), the said contact ribs being supported by the said tube body and/or the said spiral, as shown for instance at FIG. 1.

The thickness or height E of the said contact ribs is equal to at least 0.15 mm and is chosen to be fairly high so that firstly there is no radial contact with any of the said axial click-fit means, and secondly there is no radial contact other than that formed by the said lines of contact (71, 81), typically by the contact of the said tube body and the said spiral, particularly at mid-distance between the two contact lines (11,81), resulting in bending "like a beam supported at its two ends".

The height E could also depend on the nature of the materials, typically plastics, constituting the parts (3) and (4).

In an embodiment of the invention, the lower contact rib (7,70) is inclined at an angle $\alpha$ of between 30° and 60°, so as to facilitate assembly of the said tube body and the said spiral, to eventually improve the uniformity of the said torque.

In this case, the rib is compressed being bent, creating a "spring" effect generated between the rib and the spiral.

Generally, the said tube body (3) and/or the said spiral (4) are made of plastic with permanent elasticity.

Another object of the invention is a process for manufacturing of a tube according to the invention, comprising the following steps:

a) the said tube body (3) with an outside radius $R_3$ and the said spiral (4) with an inside radius $R_4$ are formed separately, where $R_3<R_4$ and typically the difference $R_4-R_3$ is between 0.025 mm and 0.075 mm, the said tube body and/or the said spiral being provided with the said axial click-fit means and radial spacers of predetermined height E, b) the said tube body and the said spiral are assembled by forced click-fitting, the height E being chosen comparatively to the difference $R_4-R_3$ so that a continuous pressure is applied at a predetermined level between the said tube and the said spiral, in order to obtain a uniform torque and a value of torque corresponding approximately to the standard force applied by a consumer to cause relative rotation between the said tube body and the said spiral.

EXAMPLE OF EMBODIMENT

Figure 2:
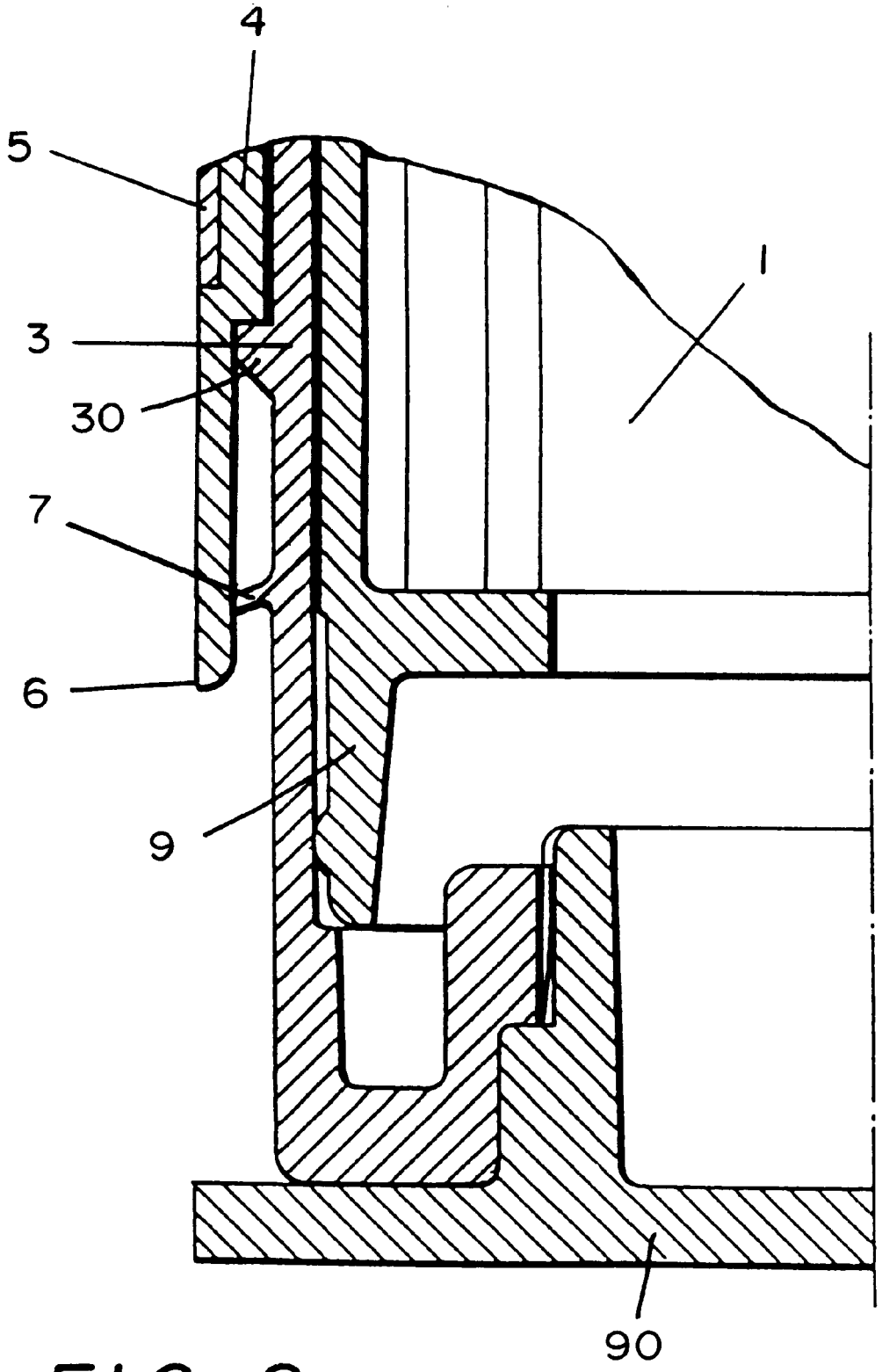
FIG. 2 shows an enlarged detail of the tube in FIG. 1.

Tubes according FIGS. 1 to 2 have been manufactured. These figures show that, like any normal tube of this type, the lipstick tube proposed by the invention comprises firstly a bottom part (9) which will hold and fix the lower end of the lipstick tube (not shown), the bottom part being equipped with a pair of radial pins (not shown in the figures) which pass through the longitudinal grooves (2) formed in the tube body (3) that protects the entire lipstick and on which the spiral (4) is fitted coaxially on the outside, the spiral being provided with an aesthetic external casing (5), usually made in aluminum, the internal surface of the spiral (4) being provided with a pair of helical grooves (not shown on the figures) into which the free ends of the above mentioned pins fit, such that the rotation and relative movement of the spiral (4) with respect to the tube body (3) causes an axial displacement in one or another direction of the bottom part (1), consequently pushing the associated lipstick in or out.

The tube body (3) includes ribs (7) arid (8), respectively close to the lower end (6) and upper end of the spiral (4), in contact with the internal surface of the said spiral as shown in FIG. 2, such that the appropriate size E of the said ribs (7) and (8) causes linear circumferential contacts (71) and (81) between the tube body (3) and the spiral (4), which considerably minimizes the contact area between the two elements and consequently minimizes the coefficient of friction during relative movement of one part with respect to the other, which according to the objective of the invention can result in a uniform and appropriate torque without the need for any lubricant between the two parts.

It is to be noted that the rib (7), which can be in any position, should preferably be tilt slightly downwards and outwards, firstly in order to facilitate placement of the tube body (3) within the spiral (4), to the extent that this inclination makes this operation easier, facilitated particularly by the rounded edge (6) of the spiral (4), and secondly to obtain a sort of "tapered" foil that may be slightly oversized with respect to the inside diameter of the spiral (4) in this area, in order to exert a slight permanent pressure between the rib (7) and the spiral (4) or (which is equivalent) between the tube body (3) and the spiral (4), improving the magnitude and uniformity of the torque.

More specifically, the applicant has manufactured tubes having ribs (7,8) of different heights E, the parts (3) and (4) having a constant clearance given by $R_4-R_3>0$. The applicant has observed that the torque was very dependent from $E/(R_4-R_3)$. If $E/(R_4-R_3)$ is too low, the torque is too low or there is no torque at all.

If $E/(R_4-R_3)$ is too high, the torque tends to go beyond the acceptable upper limit.

Therefore, the invention allows for the adaptation of the torque to any specific demand, tubes with the same torque being not necessarily used in all the countries in the world.

ADVANTAGES OF THE INVENTION

The invention solves the set problem in a simple and economical way, avoiding the use of any lubricant. Moreover, as pictured in the drawings, the invention can give rise to a number of embodiments, which is very useful in a field where the permanent changing is a necessity. At last, the invention allow for the "fine tuning" of the level of the torque by plying typically of the height of the ribs (7,8).

What is claimed is:

1. Lipstick tube (1) comprising a cylindrical tube body (3), provided with a wall with typically vertical grooves (2), inside which a bottom part (9) moves supporting a lipstick and equipped with two pins which pass through the grooves in the tube body, and move along the helical grooves (40) formed on the inside of an external spiral (4) coaxially surrounding the said tube body (3), such that relative movement of rotation between the tube body (3) and the spiral (4) causes axial displacement of the bottom part (9) and consequently the lipstick attached to it, characterized in that:

a) the said tube body (3) and the said spiral (4) comprise click-fit means in the axial direction that work together to permanently assemble the said tube body (3) and the said spiral (4), b) the said tube body (3) and/or the said spiral (4) comprise at least radial spacer (7,70,8,80) of thickness E which forms a circumferential linear contact (71,81), at one of their common ends, and the radial dimensions of the said tube body (3) and the said spiral (4), and particularly the thickness E and the difference $R_4-R_3$ between the inside radius $R_4$ of the said spiral (4) and the outside radius $R_3$ of the said tube body (3), being chosen such that, after click-fitting, a predetermined permanent mutual pressure is exerted between the said tube body (3) and the spiral (4) along said contact (71,81), so as to give a minimum contact surface area between the spiral (4) and the tube body (3) and to obtain a uniform torque of predetermined level in the relative rotation movement between the two elements (3) and (4), without the use of any lubricant wherein, the thickness $E_{7,8,70,80}$ of the said adjacent radial spacer is chosen to be greater than the thickness $E'_{30}$ of the said part of the said click-fit means, the difference in thickness E−E' being equal to at least 0.025 mm.

2. Tube according to claim 1, in which the said tube body (3) comprises top (31) and bottom (30) stops that axially block the said spiral (4) by cooperation either with at least one end (46) of the said spiral, or with at least one shoulder (41) so as to form the said click-fit means.

3. Tube according to claim 2, in which the said spiral click-fits with the said tube body, either by one end (46) and a shoulder (41), or by both ends (46) and (47), or by two shoulders (41) and (48).

4. Tube according to claim 1, in which the said spiral (4) comprises top (43) and bottom (42) stops that axially block the said tube body (3) by cooperation either with at least one end (35) of the said tube body, or with at least one shoulder (32) in order to form the said click-fit moans.

5. Tube according to claim 4, in which the said tube body click-fits with the said spiral either through one end (35) and one shoulder (32), or by two shoulders (32) and (36).

6. Tube according to claim 4, in which the said click-fit means involves cooperation between a rib (33, 45) and an axial blocking groove (44, 34), the said tube body supporting the said rib (33) or the said groove (34) and the said spiral supporting the said groove (44) or the said rib (45) respectively.

7. Tube according to claim 6 comprising two radial spacers (7 or 70) and (8 or 80), one being located in the first third of the common height $D_{43}$, the other being located in the third third of this common height.

8. Tube according to claim 7, in which the thickness or height E of the said contact ribs is equal to at least 0.15 mm and is chosen to be fairly high so that firstly there is no radial contact with any of the said axial click-fit means, and secondly there is no radial contact other than that formed by the said lines of contact (71, 81), typically by the contact of the said tube body and the said spiral, particularly at mid-distance between the two contact lines (71,81), resulting in bending "like a beam supported at its two ends".

9. Tube according to claim 1 in which the said tube body (3) and/or the said spiral (4) are made of plastic with permanent elasticity.

10. Process for manufacturing of a tube according to claim 1 comprising the following steps:

a) the said tube body (3) with an outside radius $R_3$ and the said spiral (4) with an inside radius $R_4$ are formed separately, where $R_3<R_4$ and typically the difference $R_4-R_3$ is between 0.025 mm and 0.075 mm, the said tube body and/or the said spiral being provided with the said axial click-fit means and radial spacers of predetermined height E, b) the said tube body and the said spiral are assembled by forced click-fitting, the height F being chosen comparatively to the difference $R_4-R_3$ so that a continuous pressure is applied at a predetermined level between the said tube and the said spiral, in order to obtain a uniform torque and a value of torque corresponding approximately to the standard force applied by a consumer to cause relative rotation between the said tube body and the said spiral.

11. Lipstick tube (1) comprising a cylindrical tube body (3) Provided with a wall with typically vertical grooves (2), inside which a bottom part (9) moves supporting a lipstick and equipped with two pins which pass through the grooves in the tube body, and move along the helical grooves (40) formed on the inside of an external spiral (4) coaxially surrounding the said tube body (3), such that relative movement of rotation between the tube body (3) and the spiral (4) causes axial displacement of the bottom part (9) and consequently the lipstick attached to it, characterized in that:

a) the said tube body (3) and the said spiral (4) comprise click-fit means in the axial direction that work together to permanently assemble the said tube body (3) and the said spiral (4), b) the said tube body (3) and/or the said spiral (4) comprise at least one radial spacer (7,70,8,80) of thickness E which forms a circumferential linear contact (71,81), typically at one of their common ends, and the radial dimensions of the said tube body (3) and the said spiral (4), and particularly the thickness E and the difference $R_4-R_3$ between the inside radius $R_4$ of the said spiral (4) and the outside radius $R_3$ of the said tube body (3), being chosen such that, after click-fitting, a predetermined permanent mutual pressure is exerted between the said tube body (3) and the spiral (4) along said contact (71,81), so as to give a minimum contact surface area between the spiral (4) and the tube body (3) and to obtain a uniform torque of predetermined level in the relative rotation movement between the two elements (3) and (4), without the use of any lubricant the said radial spacers between the said tube body (3) and the said spiral (4) consist of an upper circular contact rib (8, 80) and a lower contact rib (7, 70) that form a "circular ring/cylinder" type tangential contact with two lines of contact (71, 81), said contact ribs being supported by the said tube body and/or said the spiral, in which at least the lower contact rib (7,70) is inclined at an angle $\alpha$ of between 30° and 60°, so as to facilitate assembly of the said tube body and the said spiral, to eventually improve the uniformity of the said torque.

* * * * *